US008567984B1

(12) United States Patent
Tierney

(10) Patent No.: US 8,567,984 B1
(45) Date of Patent: Oct. 29, 2013

(54) ILLUMINATING SHELF/MANTEL

(76) Inventor: Simonee Tierney, Warwick, NY (US)

( * ) Notice: Subject to any disclaimer, the term of this patent is extended or adjusted under 35 U.S.C. 154(b) by 454 days.

(21) Appl. No.: 12/583,168

(22) Filed: Aug. 14, 2009

Related U.S. Application Data

(63) Continuation-in-part of application No. 11/705,328, filed on Feb. 12, 2007, now abandoned, which is a continuation-in-part of application No. 10/840,598, filed on May 7, 2004, now abandoned.

(51) Int. Cl.
*F21L 19/00* (2006.01)

(52) U.S. Cl.
USPC ..... 362/179; 362/127

(58) Field of Classification Search
USPC ..... 362/127, 131–134, 179, 364, 33, 98–99
See application file for complete search history.

(56) References Cited

U.S. PATENT DOCUMENTS

| | | | | |
|---|---|---|---|---|
| 3,019,331 | A * | 1/1962 | Geist | 362/97.4 |
| 3,025,389 | A * | 3/1962 | Esch | 362/147 |
| 3,133,703 | A * | 5/1964 | Monroe | 362/658 |
| 4,595,094 | A * | 6/1986 | Reid | 362/154 |
| 5,205,638 | A * | 4/1993 | Squitieri | 362/125 |
| 5,217,293 | A * | 6/1993 | Kobzeff | 362/97.1 |
| 6,752,090 | B2 * | 6/2004 | Schenker et al. | 108/115 |
| 2005/0157505 | A1 * | 7/2005 | Dow et al. | 362/374 |
| 2006/0191529 | A1 * | 8/2006 | McDonald | 126/500 |

* cited by examiner

*Primary Examiner* — Julie Shallenberger
(74) *Attorney, Agent, or Firm* — Philip Furgang, Esq.; Furgang & Adwar, LLP

(57) ABSTRACT

A device and method for providing illumination from a shelf or mantel shelf is provided. A housing recess within the shelf includes a base, front, side, and rear walls extending perpendicular from and along the perimeter of the base. A top panel covers the recess, is coplanar with the top surface of the shelf and permits the dispersion of light through the top side. A multiplicity of lights are positioned within the recess along the perimeter of the base to provide even dispersal of the light from the shelf.

5 Claims, 3 Drawing Sheets

ILLUMINATING SHELF/MANTEL

This application is a continuation-in-part of application Ser. No. 11/705,328, filed Feb. 12, 2007 now abandoned, which, in turn, was a continuation-in-part of application Ser. No. 10/840,598, filed May 7, 2004, now abandoned.

FIELD OF THE INVENTION

The device disclosed relates to means of illumination provided from a shelf or shelf of a mantel.

BACKGROUND

It is known in the prior art to provide a light box or to provide lighting for a translucent shelf from beneath.

One patent disclosing the concept of a light box is U.S. Pat. No. 1,647,181 issued to Koberling which discloses a wall ornamentation including light bulbs disposed within the box forming part of the wall above a fireplace. However, in this situation, it is not an illuminated mantel, rather, it is a light box as part of the wall above a fireplace.

U.S. Pat. No. 2,503,945 issued to Grossniklaus discloses a mantel forming an aquarium and incorporating a fountain. However, this is wholly unlike the present device.

While these devices may be suitable for the purposes for which they were designed, they would not be suitable for the purposes of the present device, as hereinafter described.

SUMMARY

There is provided a device for providing illumination from a mantel or shelf. This device includes a housing. The housing includes a front wall, a base wall, and a back wall which extends along the length of the base wall and is opposed to the front wall. The base, front, and back walls define a recess within the shelf. A source of light is positioned within the recess and extends proximate the perimeter of the base to provide substantially even dispersal of the light form the shelf. The housing further comprising a top panel for covering the recess and permitting the dispersion of the light therethrough.

The device may also include any or all of the following feature: At least one source of electrical power positioned within the recess. The top wall includes at least one aperture for selectively removing the top panel to provide access into the recess and for passing a power cord through the aperture so that the power chord may be connected to the power source. The top panel is translucent. The exposed surface of the shelf has therein a groove for receiving and holding objects proximate the recess. The recess can have first and second sidewalls extending from the base on opposing sides of the base wall and attached to the front and back walls. The top panel has two apertures positioned adjacent opposed side edges and midway along the length of the side edges and is transparent. The source of electrical power comprises at least two electrical outlets each one substantially aligned with one of the apertures. The recess is within the top horizontal wall of the shelf. The panel is coplanar with the top surface of the shelf. The source of power comprises an electric line connected to the light source. A light switch connected to the line for turning on or off or selectively restricting the flow of electricity to the light source. The light source comprises individual light bulbs.

There is provided a method of providing illumination from a shelf comprising the activities of: providing a recess in the shelf and having a base wall; providing a translucent top panel; covering the recess with the translucent top panel; raising the panel to provide access to a recess therein; positioning at least one light source within the recess so disposed upon the base wall along the periphery thereof so as to provide a substantially uniform light the edges of the panel; connecting the at least one light source to a power source; and closing the translucent top wall.

The method may also include any or all of the following features: attaching the shelf above a fireplace; actuating the light source to disperse light through the translucent top panel.

There is provided a method of providing illumination from a shelf comprising the activities of: providing a translucent panel coplanar with the top surface of the shelf; raising the panel to provide access to a recess therein; providing a source of light within the recess; extending a power cord connected to a lamp through an aperture in the panel; connecting the power cord to a power source positioned within the recess; closing panel; positioning the lamp atop the panel; and extending the power cord through the aperture to the power source within the recess.

The method may include any or all of the following features: comprising the activity of attaching the shelf to a wall above a fireplace; actuating the light source within the recess so as to disperse light through the translucent top of the shelf.

BRIEF DESCRIPTION OF THE DRAWING FIGURES

In order that the device may be more fully understood, it will now be described, by way of example, with reference to the accompanying drawing in which.

DETAILED DESCRIPTION

Figure 1:
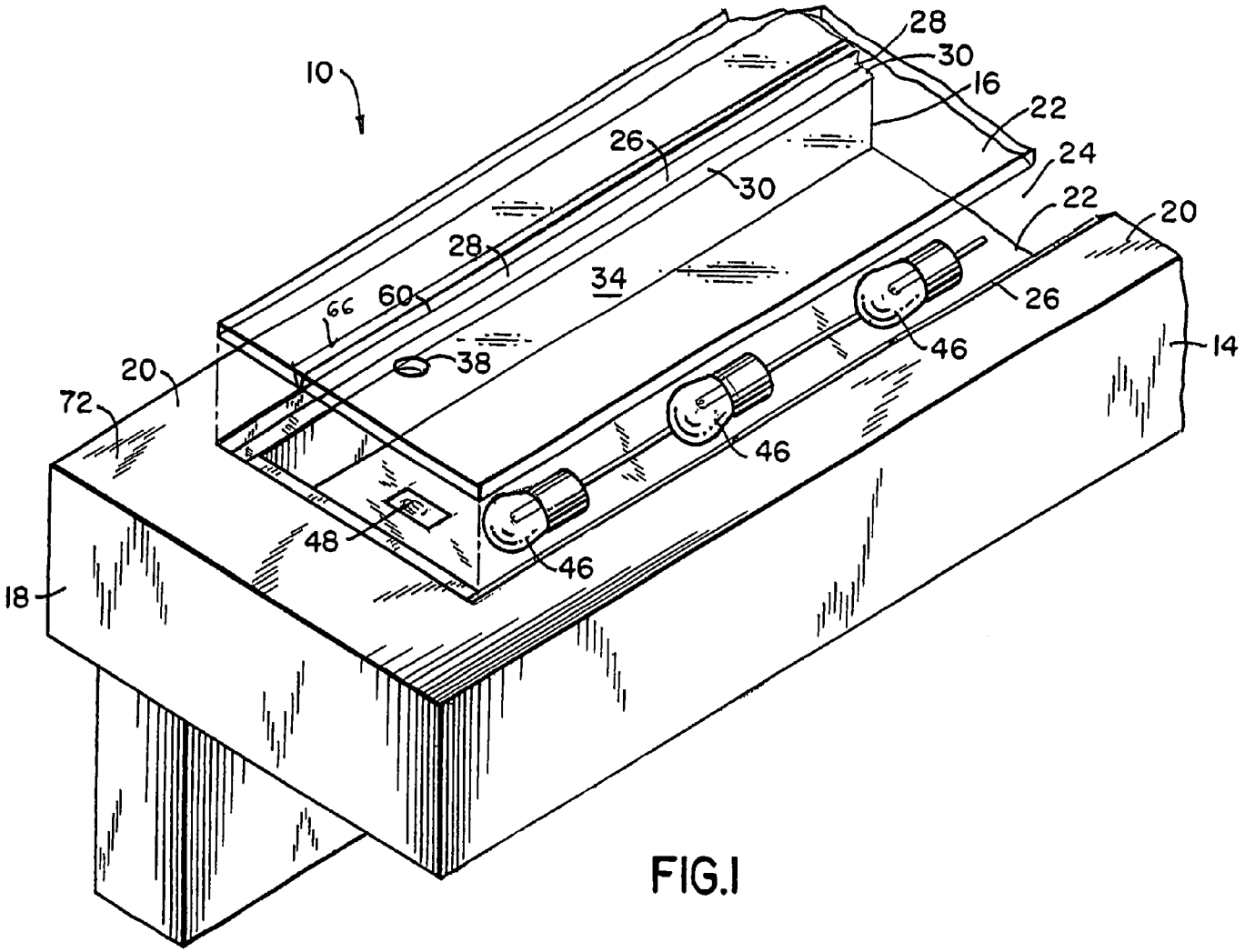
FIG. 1 is a partially sectioned top perspective view of an illuminated mantel with an exploded view of the top cover.

Described is a shelf for providing illumination of articles which may be disposed thereon or adjacent thereto. In this example there is shown (FIGS. 1, 2, and 3) a mantel housing 10. The mantel 10 may have any shape as is well known in the art. In this example the mantel 10 has a generally cuboid shape defined by a front 14 and sidewalls 18 (only one sidewall is shown in the drawings) and a top wall or shelf 20. The mantel 10 may be made of any structural material such as wood, plastic, metal, or the like or any combination thereof.

Figure 2:
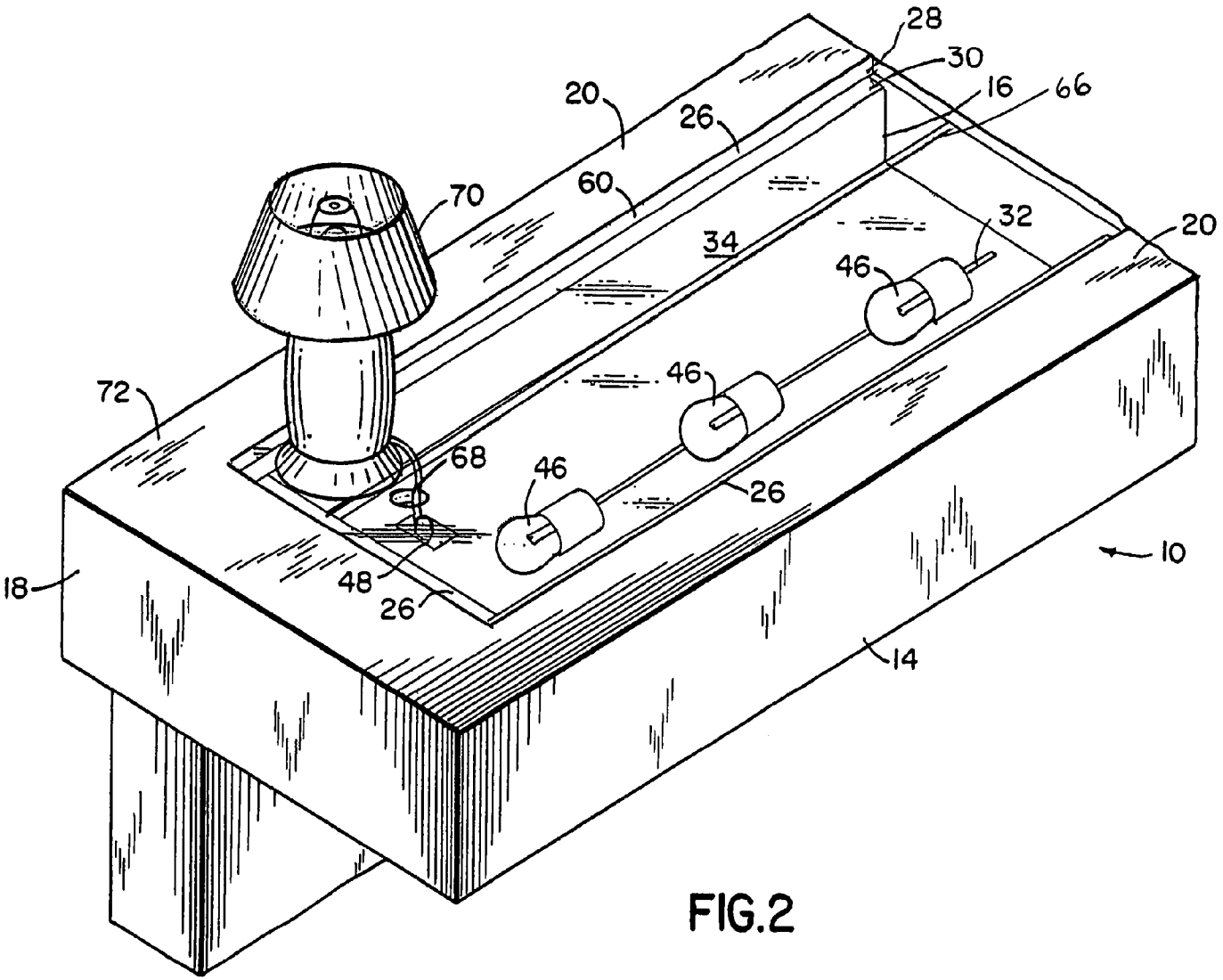
FIG. 2 is a top perspective view of the complete mantel of FIG. 1.
Figure 3:
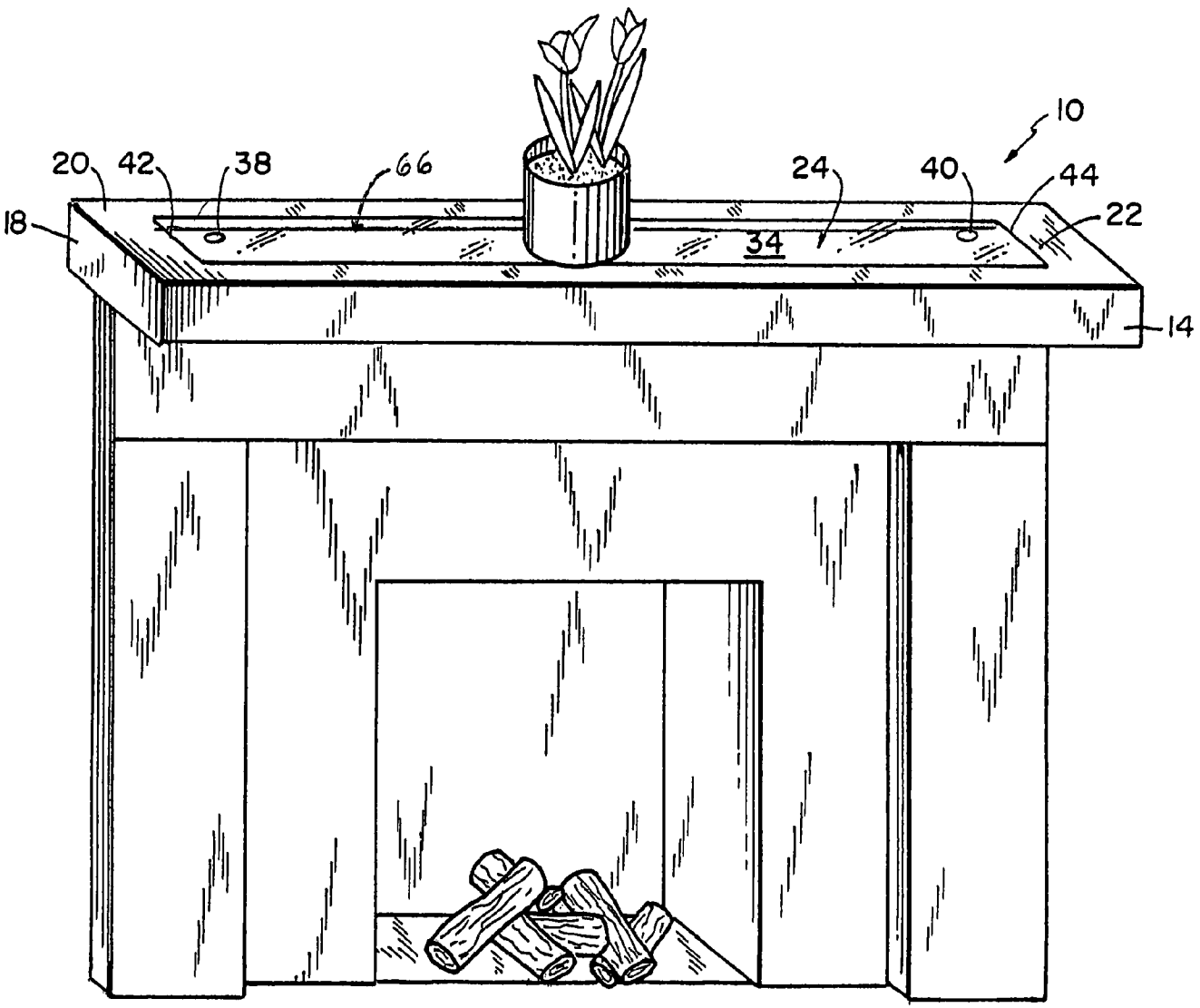
FIG. 3 is the perspective view of FIG. 1 assembled.

Within the shelf 20 is a recess 22 which may take any desired shape. In this example the recess 22 is a cuboid. Access to the recess 22 is obtained through the top surface 72 in the top wall 20 of the mantel 10. Thus, in this example, the recess 22 has a rectangular opening 24 (FIGS. 1, 2). The recess opening 24 may be disposed symmetrically within the top wall 20. Alternatively, the recess my be disposed asymmetrically and/or there may be a plurality of such openings (not shown).

The recess 22 is defined, in this example, by a planar rear wall 16, planar sidewalls (one is visible in an edge view) and a front wall (not visible) and a planar base or bottom wall 12.

A chamfer 26 is within the rectangular opening 24 of the recess 22. The chamfer 26 may be defined by an exposed vertical edge 28 extending from the top surface 72 within the recess 22 and a horizontal edge 30 of the upper free end of the back 16, side and front walls, within the opening 24 and spaced below the top surface 72.

There may be at least one display groove 66 may be within the top wall 20 of the mantel 10 disposed adjacent the opening 24 and proximate the rear edge 60. The display grove 66 is one known in the art for use for displaying artwork, dishes or the like on shelves, breakfronts, and mantels.

A panel 34 which may be translucent or transparent may be so dimensioned as to fit within the opening 24 and be supported by the chamfer 26 be continuous with the planar top surface 72 of the top wall or shelf 20. The panel 34 may be hingedly attached as is well known in the art. For example, a hinge as is well known in the art may be secured along the rear vertical edge 36 of the panel 34 and to one of the walls 28 or 30. Such a connection of the panel 34 is old in the art.

In this example, however, the panel 34 is not hingedly connected to the shelf 20. There may be at least one aperture extending through the panel 34. In this example, due to the size of the panel 34, which extends substantially the length of the shelf 20, there are two such apertures 38, 40. Each aperture 38, 40 is positioned adjacent the respect opposed side edges 42, 44 of the panel 34, one half the length of the edges 42, 44.

Within the base wall 12 of the recess 22 may be two electrical outlets 48 (only one is visible). The electrical outlets may be positioned directly under the respective apertures 38, 40.

Lighting means which, in this example, are a plurality of wheat lights 46 are within the recess 20 attached to the base wall 12 by means well known in the art. Any other source of lighting may be used, including LEDs and solid state miniature track or continuous lighting. The lights 46 must be arranged proximate the front, rear 34 and side walls of the recess 22 to provide even dispersion of the light from the panel.

The bulbs 46 may be connected in serial or parallel to any well known power source by means of a typical electric chord with an on/off-dimmer switch which is well known in the art (not shown). So, too, the pair of electrical double outlets 48 may be electrified by means well known in the art and the power controlled by an on/off switch (not shown). The apertures 38, 40 are so dimensioned as to be capable of receiving the thumb of a user and passing therethrough a typical electrical plug.

As shown, the recess 22 is an integral part of the top shelf 20. The sides of the recess 22 may formed as a separate box and then installed within the shelf 20 or integrally formed within the shelf 20. In this example, upon assembly, the cuboid box is inserted into the opening 24 and secured to the side edge 26 of the top wall 20 as by screws, adhesives, or the like which are well known in the art.

In use, the panel 34 may be conveniently removed from the top wall 20 of the mantel 10 by means of the two thumb holes 38, 40. This is particularly useful with relatively large panels. Upon removal of the panel 34 the user gains convenient and easy access to the electrical outlets 48 and to install or replace any of the bulbs 46. Additionally, a conventional electric chord 68 of a lamp 70 may be threaded through the apertures 38 and/or 40 and plugged into the adjacent outlet 48. If the mantel 10 is positioned so that a person in the room will not easily see the top wall 20, the illumination sets off any works of art or similar items placed upon and above the panel 34 or on the top wall 20 adjacent the panel 34, including in the display groove 66.

What is claimed is:

1. A method of providing illumination from a shelf comprising the activities of:

providing a translucent panel coplanar with the top surface of the shelf;

raising the panel to provide access to a recess therein;

providing a source of light within the recess;

extending a power cord connected to a lamp through an aperture in the panel;

connecting the power cord to a power source positioned within the recess;

closing the panel;

positioning the lamp atop the panel; and extending the power cord through the aperture to the power source within the recess.

2. The method as recited in claim 1 further comprising the activity of attaching the shelf to a wall above a fireplace.

3. The method as recited in claim 2 further comprising the activity of actuating the light source within the recess so as to disperse light through the translucent top of the shelf.

4. A device for providing illumination from a mantel or shelf comprising:

a housing including a front wall;

a bottom wall; a back wall which extends along the length of said bottom wall and opposed to said front wall; said bottom, front, and back walls defining a recess within the shelf and wherein the exposed surface of the shelf having therein a groove for receiving and holding objects proximate said recess; said recess further comprises first and second sidewalls extending from said bottom on opposing sides of said bottom wall and attached to said front and back walls; said recess being within the top horizontal wall of the shelf;

a source of light comprising at least one light bulb positioned within said recess and extending proximate the perimeter of said bottom to provide substantially even dispersal of the light form the shelf;

a light switch connected to said line for turning on or off or selectively restricting the flow of electricity to said light source;

a source of power comprising an electric line connected to said light source; said housing further comprising a top panel, either translucent or transparent, for covering said recess and permitting the dispersion of light therethrough; said top panel having two apertures positioned adjacent opposed side edges and midway along the length of said side edges; said panel being coplanar with the top surface of the shelf, wherein said apertures are for selectively removing said top panel to provide access into said recess and for passing a power cord through said aperture so that the power chord may be connected to said power source at least two electrical outlets within said recess, each one of said outlets substantially aligned with one of said apertures positioned within said recess.

5. A device for providing illumination from a mantel or shelf comprising: a housing including: a front wall; a bottom wall; a back wall which extends along the length of said bottom wall and opposed to said front wall; said bottom, front, and back walls defining a recess within the shelf; said recess comprising first and second sidewalls extending from and on opposed sides of said bottom wall and attached to said front and back walls; and a source of light positioned within said recess and extending proximate the perimeter of said bottom to provide substantially even dispersal of the light form the shelf;

said housing further comprising a translucent or transparent top panel for covering said recess and permitting the dispersion of light therethrough; at least one source of electrical power positioned within said recess;

a source of power comprising an electric line connected to said light source; a light switch connected to said line for turning on or off or selectively restricting the flow of electricity to said light source; said light source comprises individual light bulbs;

the exposed surface of the shelf having therein a groove for receiving and holding objects proximate said recess;

said panel having two apertures positioned adjacent opposed side edges and midway along the length of said side edges, said source of electrical power comprises at least two electrical outlets each one substantially aligned with one of said apertures; said recess being within the top horizontal wall of the shelf; said panel being coplanar with the top surface of the shelf; wherein said apertures are for selectively removing said top panel to provide access into said recess and for passing said power chord through said aperture so that said power chord may be connected to said power source.

* * * * *